US010619385B2

(12) United States Patent
Cetnar

(10) Patent No.: US 10,619,385 B2
(45) Date of Patent: Apr. 14, 2020

(54) CLOSURE LATCH FOR A REAR VEHICLE DOOR HAVING AN EMERGENCY CHILD LOCK RELEASE MECHANISM

(71) Applicant: Magna Closures Inc., Newmarket (CA)

(72) Inventor: Roman Cetnar, Newmarket (CA)

(73) Assignee: MAGNA CLOSURES INC., Newmarket (CA)

( * ) Notice: Subject to any disclaimer, the term of this patent is extended or adjusted under 35 U.S.C. 154(b) by 352 days.

(21) Appl. No.: 15/605,077

(22) Filed: May 25, 2017

(65) Prior Publication Data

US 2017/0350170 A1 Dec. 7, 2017

Related U.S. Application Data

(60) Provisional application No. 62/344,695, filed on Jun. 2, 2016.

(51) Int. Cl.

| | |
|---|---|
| ***E05B 81/90*** | (2014.01) |
| ***E05B 77/26*** | (2014.01) |
| *E05B 85/00* | (2014.01) |
| *E05B 81/06* | (2014.01) |
| *E05B 77/30* | (2014.01) |
| *E05B 81/78* | (2014.01) |
| *E05B 81/34* | (2014.01) |
| *E05B 81/16* | (2014.01) |
| *E05B 81/14* | (2014.01) |
| *E05B 77/32* | (2014.01) |

(52) U.S. Cl.

CPC ..... *E05B 81/90* (2013.01); *E05B 77/26* (2013.01); *E05B 77/30* (2013.01); *E05B 77/32* (2013.01); *E05B 81/06* (2013.01); *E05B 81/14* (2013.01); *E05B 81/16* (2013.01); *E05B 81/34* (2013.01); *E05B 81/78* (2013.01); *E05B 85/01* (2013.01)

(58) Field of Classification Search

CPC ..... E05B 81/90; E05B 77/26; E05B 77/265; E05B 77/30; E05B 77/32; E05B 81/06; E05B 81/14; E05B 81/15; E05B 81/16; E05B 81/34; E05B 81/36; E05B 81/78; E05B 85/01

USPC ..... 292/92

See application file for complete search history.

(56) References Cited

U.S. PATENT DOCUMENTS

| | | | | |
|---|---|---|---|---|
| 5,894,906 | A | 4/1999 | Weber | |
| 8,141,916 | B2 * | 3/2012 | Tomaszewski | E05B 77/26 292/201 |
| 8,474,888 | B2 * | 7/2013 | Tomaszewski | E05B 77/26 292/201 |
| 2008/0203737 | A1 * | 8/2008 | Tomaszewski | E05B 77/26 292/216 |

(Continued)

FOREIGN PATENT DOCUMENTS

| | | |
|---|---|---|
| WO | WO2009030046 A1 | 3/2009 |

*Primary Examiner* — Nathan Cumar

(74) *Attorney, Agent, or Firm* — Dickinson Wright PLLC

(57) ABSTRACT

The present disclosure is directed to integration of a manually-controlled lock release mechanism into a vehicle closure system to permit manual actuation of the lock mechanism within a closure latch assembly in the event of a power loss situation. The lock mechanism that can be manually shifted from a child-locked state to a child-unlocked state via actuation of a manually-operable lock release actuator located along the B-pillar of the vehicle.

17 Claims, 10 Drawing Sheets

(56) References Cited

U.S. PATENT DOCUMENTS

2012/0098279 A1* 4/2012 Singh ..... E05B 85/243
292/200

* cited by examiner

CLOSURE LATCH FOR A REAR VEHICLE DOOR HAVING AN EMERGENCY CHILD LOCK RELEASE MECHANISM

CROSS-REFERENCE TO RELATED APPLICATIONS

This application claims the benefit of U.S. Provisional Application No. 62/344,695 filed Jun. 2, 2016. The entire disclosure of the above application is incorporated herein by reference.

FIELD

The present disclosure relates generally to closure latch assemblies for motor vehicle closure systems. More particularly, the present disclosure relates to a closure latch assembly with a child lock mechanism and to a vehicle closure system equipped with the closure latch assembly and an emergency child lock release mechanism.

BACKGROUND

This section provides background information related to the present disclosure which is not necessarily prior art.

Passive entry systems for vehicles are provided on some vehicles to permit a vehicle user who is in possession of a vehicle key fob to simply pull the door handle and open the door without the need to introduce a key into a keyhole in the door. The key fob is typically equipped with an electronic device that communicates with the vehicle's on-board control system to authenticate the user. When the user pulls the outside door handle to indicate that he/she wishes entry into the vehicle, an electric power release actuator associated with a door-mounted closure latch assembly is actuated to release a latch mechanism so as to unlatch and open the door. In some passive entry systems, the outside door handle is also be equipped with a switch that triggers actuation of the electric power release actuator. The latch mechanism may also be mechanically released from inside the vehicle when the inside door handle is connected to the latch mechanism via an inside latch release mechanism associated with the closure latch assembly. In some jurisdictions, however, there are regulations that govern the degree of connection provided by the inside latch release mechanism between the inside door handle and the latch mechanism (particularly for a rear door, where children may be the occupants).

As is known, a problem associated with closure latch assemblies equipped with various power-operated features (i.e. power release, power lock, power child lock, etc.) is the ability to release the latch mechanism to open the door in the event of a failure of the main power supply and/or an interruption or breaking of the electrical connection between the main power supply and the electric power release actuator within the closure latch assembly. Such non-powered situations may occur, for example, as a result of a crash or accident involving the motor vehicle. This loss of powered operation is particularly problematic if the closure latch assembly is equipped with a child lock mechanism which cannot be released or accessed in the absence of electrical power.

While commercially-available closure latch assemblies are satisfactory to meet operational and regulatory requirements, a recognized need exists to advance the development of closure latch assemblies having reduced complexity and packaging while providing additional features such as an emergency child lock release mechanism.

SUMMARY

This section provides a general summary of the disclosure and is not intended to be interpreted as a comprehensive disclosure of its full scope or all of its features, aspects and objectives.

In an aspect, the present disclosure provides a vehicle closure system equipped with an emergency release mechanism operable for manually releasing a closure latch assembly. Specifically, it would be advantageous to provide an emergency child lock release mechanism that can be used to open a rear door of a motor vehicle under all instances, including when the motor vehicle loses power.

It is another aspect of the present disclosure to equip the emergency release mechanism with a manually-controlled release actuator located along a B-pillar of the motor vehicle and which is accessible for actuation when the front door is opened to permit subsequent release of the closure latch assembly associated with the rear door.

It is yet another aspect of the present disclosure to permit actuation of the manually-controlled release actuator to shift a child lock mechanism from a child-locked state into a child-unlocked state to permit inside release of the rear door.

In a particular embodiment, the vehicular closure system includes a closure latch assembly and an emergency child lock release mechanism. The closure latch assembly includes a latch mechanism having a ratchet and a pawl. The ratchet is movable between a striker release position and a striker capture position and is biased toward the striker release position. The pawl is movable between a ratchet holding position whereat the pawl holds the ratchet in the striker capture position and a ratchet releasing position whereat the pawl permits the ratchet to move to the striker release position, the pawl being biased toward the ratchet locking position. The closure latch assembly also includes an inside release lever operatively connectable to the pawl and a lock mechanism. The lock mechanism includes a lock member pivotable between an unlock position whereat the lock link operatively connects the inside release lever to the pawl and a lock position whereat the inside release lever operatively disconnects the inside door release lever from the pawl, the lock member being biased toward the unlock position. The lock mechanism further includes a power-operated cam arrangement having a lock cam rotatable between an unlocking position whereat the lock cam permits the lock member to move to the unlock position and a locking position whereat the lock cam moves the lock member to the lock position. The lock mechanism is operable in an unlocked state when the lock member is in the unlock position; is operable in a locked state when the lock member is in the lock position and the lock cam is in the unlocking position; and is operable in a child-locked state when the lock member is in the lock position and the lock cam is in the locking position. In addition to the closure latch assembly, the emergency child lock release mechanism of the vehicular closure system includes a manually-controlled release actuator and a coupling device operatively connecting the release actuator to the lock mechanism so as to permit manual shifting of the lock mechanism from the child-locked state to the locked state.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

The present disclosure will now be described by way of example only with reference to the attached drawings, in which.

Corresponding reference numerals indicate corresponding parts throughout the several views of the drawings.

DETAILED DESCRIPTION

In general, the present disclosure relates to providing a manually-operated release mechanism for shifting a lock mechanism associated with a closure latch assembly, such as a child lock mechanism, from a child-locked mode into a child-unlocked mode when electrical power to the closure latch assembly is lost or interrupted. Accordingly, non-limiting example embodiments of closure latch assemblies of the type equipped with a power-operated lock mechanism and adapted for use in motor vehicle door closure systems are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
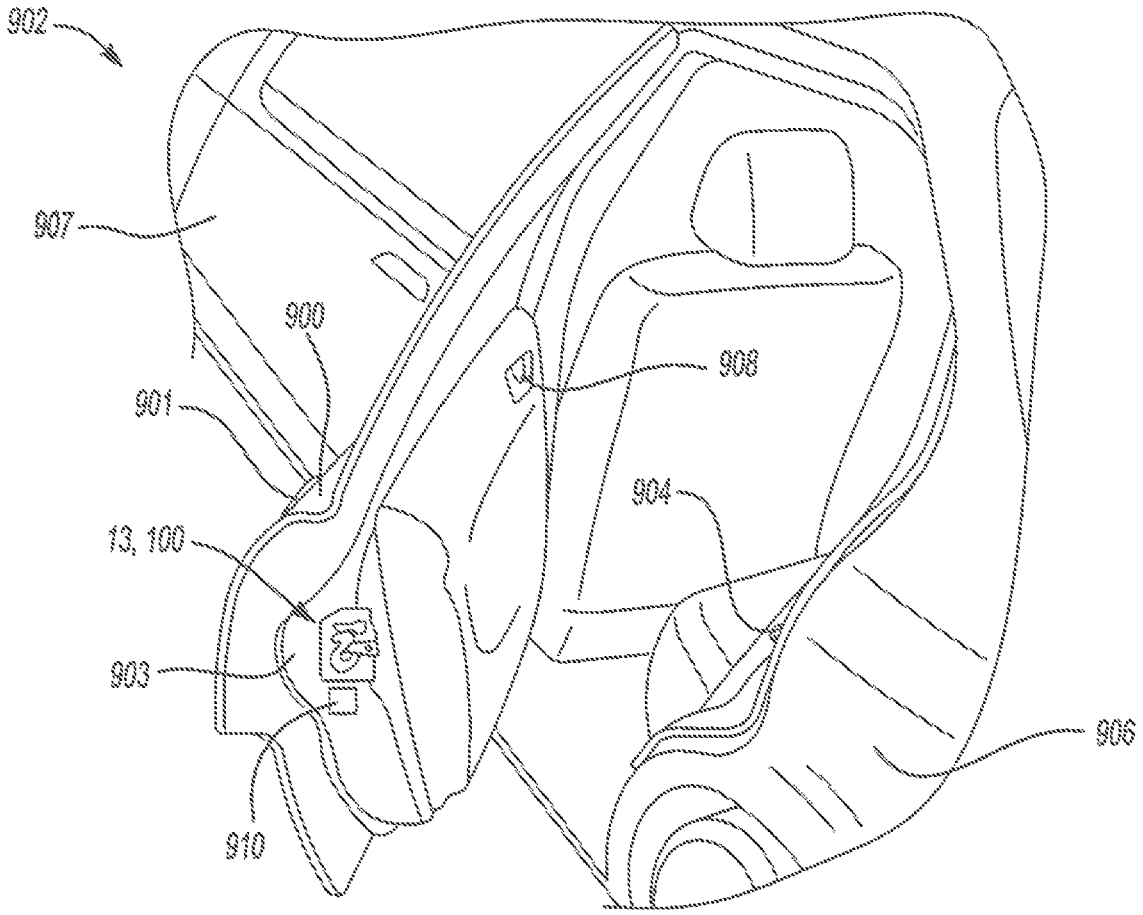
FIG. 1 is a partial perspective view of a motor vehicle with a rear passenger door equipped with a closure latch assembly.

Reference is made initially to FIG. 1 which shows an embodiment of a closure latch assembly 13 mounted to a rear passenger door 900 of a motor vehicle 902. The closure latch assembly 13 is positioned on a rear edge face 903 of the rear door 900 and is arranged in a suitable orientation to engage a striker 904 mounted on the vehicle body 906 when the rear door 900 is closed. Motor vehicle 902 also includes a front passenger door 907. Rear door 900 is shown to also include an outside door handle 901, an inside door handle 908, and a child lock mechanism 910 associated closure latch assembly 13.

Figure 2:
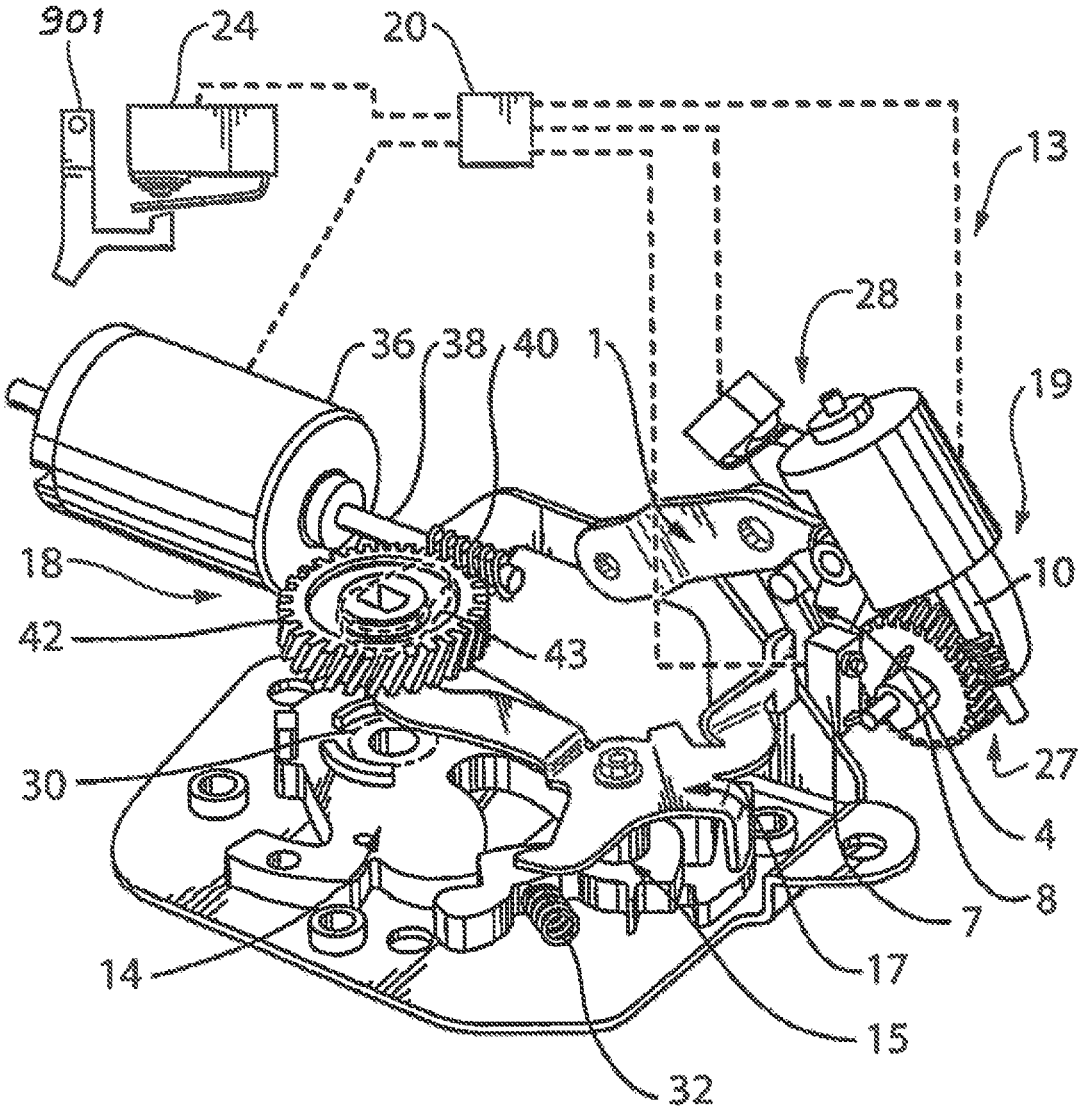
FIG. 2 is an elevation view of various components associated with the closure latch assembly shown in FIG. 1.

Referring now to FIG. 2, a first non-limiting embodiment of the closure latch assembly 13 is shown to generally include a latch mechanism, a latch release mechanism, a power release mechanism, an inside door release mechanism, and a power lock mechanism with a double pull manual release function. The latch mechanism includes a ratchet 14 and a pawl 15. Ratchet 14 is moveable between a striker capture position whereat the ratchet 14 retains the striker 904 and a striker release position whereat the ratchet 14 permits release of the striker 904. A ratchet biasing member, such as a torsion spring 30, biases ratchet 14 toward the striker release position. The pawl 15 is pivotably moveable relative to ratchet 14 between a ratchet holding position whereat the pawl 15 holds the ratchet 14 in its striker capture position and a ratchet releasing position whereat the pawl 15 permits the ratchet 14 to move to its striker release position. A pawl biasing member, such as a coil spring 32, biases pawl 15 toward its ratchet holding position.

The latch release mechanism includes a pawl release lever 17 operatively connected to the pawl 15 and which is movable between a pawl release position whereat the pawl release lever 17 causes the pawl 15 to move to the ratchet releasing position and a home position whereat the pawl release lever 17 permits the pawl 15 to be maintained in the ratchet holding position. A release lever biasing member, such as a suitable spring 34, is provided to bias the pawl release lever 17 to the home position. The pawl release lever 17 may be moved from the home position to the pawl release position by several components, such as, for example, the power release mechanism, the outside door release mechanism, or the inside door release mechanism.

The power release mechanism 18 includes a power release motor 36 having a motor output shaft 38, a power release worm gear 40 secured to the output shaft 38, a power release (PR) gear 42, and a power release (PR) cam 43. The PR cam 43 is connected for common rotation with the PR gear 42 and is rotatable between a pawl release range of positions and a pawl non-release range of positions. In FIG. 2, the PR cam 43 is in a position that is within the pawl non-release range. The PR gear 42 is driven by the worm gear 40 and in turn drives the PR cam 43 which drives the pivoting movement of the pawl release lever 17 between its home and pawl release positions.

The power release mechanism 18 may be used as part of a passive entry feature. When a person approaches the vehicle with an electronic key fob and actuates (i.e. pulls) the outside door handle 901, the vehicle detects both the presence of the key fob and that the outside door handle 901 has been actuated (e.g. via communication between a handle switch 24 and an electronic control unit (ECU) shown at 20 that at least partially controls the operation of the closure latch assembly 13). In turn, the ECU 20 actuates the power release mechanism 18 to release the latch mechanism and unlatch the closure latch assembly 13 for opening the rear door 900.

The power lock mechanism 27 controls the operative connection between an inside release lever 1 associated with the inside door release mechanism and the pawl release lever 17. While not specifically shown, the inside door release mechanism includes a couple device (i.e. cable, rod, linkage, etc) connecting inside release lever 1 to inside door handle 908. The power lock mechanism 27 includes a power lock actuator 19 and a lock mechanism 28. The lock mechanism 28 is shown to include an auxiliary release lever 4, a lock link 2 and a lock lever 3. The auxiliary release lever 4 is operatively connected to the pawl release lever 17 and is movable between a home position (shown in FIG. 3A) whereat the auxiliary release lever 4 permits the pawl release lever 17 to be in the home position and an actuated position whereat the auxiliary release lever 4 forcibly moves the pawl release lever 17 to the pawl release position.

Figure 3A:
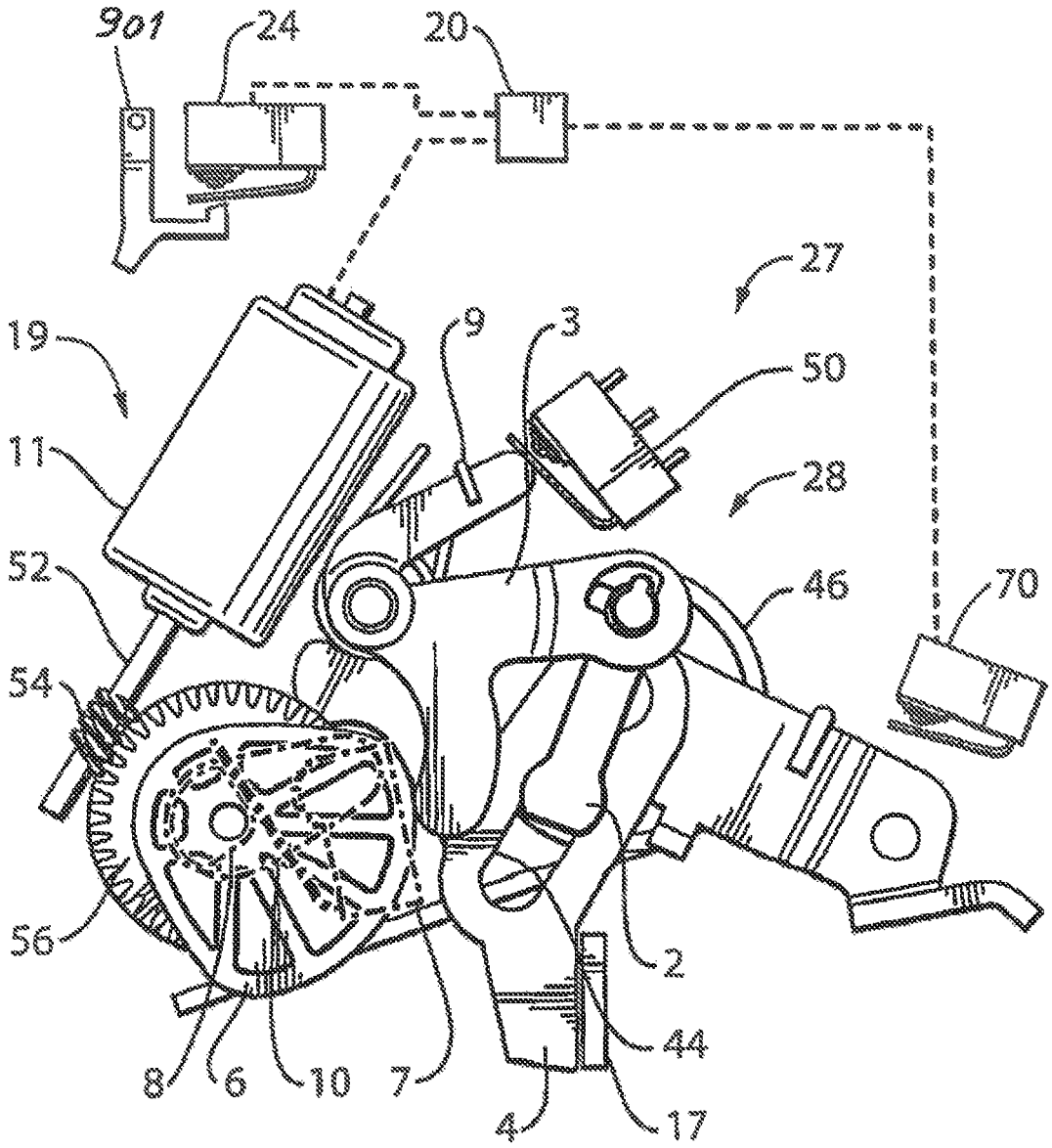
FIG. 3A is a plan view of a power-operated lock mechanism associated with the closure latch assembly shown in FIG. 2 in a locked state.

The lock link 2 is slidable within an elongated slot 44 formed in the auxiliary release lever 4 and controls the connection between the inside release lever 1 and the auxiliary release lever 4. The lock link 2 is movable between a lock position (FIG. 3A) and an unlock position (FIG. 3C). When the lock link 2 is in the unlock position, the lock link 2 is positioned in the path of the inside release lever 1 which is pivotably moveable between a home position (FIG. 3A) and an actuated position (FIG. 3B) via movement of inside door handle 901. As a result, when the inside release lever 1 is moved from the home position to the actuated position, the inside release lever 1 engages and moves the lock link 2 and, as a result, this movement also causes the auxiliary release lever 4 to rotate from the home position to the actuated position. In contrast, when the lock link 2 is in the lock position (FIG. 3A), the lock link 2 is not located in the path of the inside release lever 1. As a result, movement of the inside release lever 1 from the home position to the actuated position does not result in any corresponding movement of the auxiliary release lever 4 away from the home position. The lock lever 3 is operatively connected to the lock link 2 and is movable between a locked position (FIG. 3A) whereat the lock lever 3 positions the lock link 2 in the lock position and an unlocked position (FIG. 3C) whereat the lock lever 3 positions the lock link 2 in the unlock position. An inside release lever biasing member, such as a suitable torsion spring 46, is provided to bias the inside release lever 1 to the home position. A lock lever biasing member, such as a suitable torsion spring 9, is provided to bias the lock lever 3 to the unlocked position.

The power lock actuator 19 controls the position and operation of the lock mechanism 28. The power lock actuator 19 includes a lock motor 11 which has an output shaft 52 with a worm gear 54 thereon, a power lock (PL) gear 56 meshed with worm gear 54, a lock lever cam 6, an override member 10, a lock lever cam state switch cam 8, and a lock lever cam state switch 7. The lock lever cam 6, the override member 10 and the lock lever cam state switch cam 8 are all fixed together and rotatable with the PL gear 56. The override member 10, the switch cam 8 and the switch 7 are shown in dashed outline in FIGS. 3A-3D as a result of being obstructed from view by lock lever cam 6. The cam 8 and switch 7 are shown in FIG. 2, however.

The lock lever cam 6 is operatively connected to the lock lever 3, and is rotatable between a locking range of positions and an unlocking range of positions. When in a position that is within the locking range of positions (examples of which are shown in FIGS. 3A and 3D), the lock lever cam 6 holds the lock lever 3 in the locked position. When in a position that is within the unlocking range of positions (an example of which is shown in FIG. 3C), the lock lever cam 6 permits the lock lever 3 to move to the unlocked position.

The lock lever cam state switch cam 8 is movable between an unlocking range of positions (an example of which is shown in FIG. 3C), and a locking range of positions (an example of which is shown in FIG. 3A). Movement of the lock lever cam state switch cam 8 between the unlocking and locking ranges changes the state of the lock lever cam state switch 7. For example, the switch 7 may be open when the lock lever cam state switch cam 8 is in the locking range and may be closed when the lock lever cam state switch cam 8 is in the unlocking range, or vice versa. The state of the lock lever cam state switch 7 may be used by the ECU 20 to determine whether or not to permit the outside door handle 22 to be operatively connected to the pawl release lever 17 (via the power release actuator 18 shown in FIG. 1). It will be noted that it is alternatively possible for the operation of the switch 7 to be reversed and for the profile of the lock lever cam state switch cam 8 to be reversed, such that opening of the switch 7 would indicate to the ECU 20 that the power lock mechanism 27 was unlocked, and closing of the switch 7 would indicate to the ECU 20 that the power lock mechanism 27 was locked.

A lock lever state switch 50 can be used to indicate to the ECU 20, the state of the lock lever 3 (i.e. whether the lock lever 3 is in the locked or unlocked position). It will be understood that the lock lever state switch 50 is an alternative switch that can be provided instead of the switch 7 and switch cam 8. In other words, if the switch 50 is provided, the switch 7 and cam 8 may be omitted. Alternatively if the switch 7 and cam 8 are provided, the switch 50 may be omitted.

The override member 10 is movable between an actuatable range of positions (an example of which is shown in FIG. 3A), and a non-actuatable range of positions (examples of which are shown in FIGS. 3C and 3D). The operation of the override member 10 is described further below.

Rotation of the lock motor 11 drives the rotation of the PL gear 56 (through the worm gear 54) and therefore concurrently drives the movement of the lock lever cam 6, the lock lever cam state switch cam 8, and the override member 10.

With closure latch assembly 13 mounted in rear door 900, the power lock mechanism 27 establishes three operating states: a locked state (FIG. 3A), an unlocked state (FIG. 3C), and a child-locked state (FIG. 3D). Referring to FIG. 3C, when the power lock mechanism 27 is in the unlocked state, the lock lever cam 6 is within the unlocking range and, as a result, the lock lever 3 and the lock link 2 are in their unlocked positions. As a result, the inside release lever 1 is operatively connected to the pawl release lever 17 (and therefore to the pawl 15 shown in FIG. 2) through the lock link 2 and the auxiliary release lever 4. Thus, actuation of the inside release lever 1 to the actuated position results in the actuation of pawl release lever 17 and movement of the pawl 15 to the ratchet releasing position, thereby releasing the ratchet 14 for movement to its striker release position. Additionally, referring to FIG. 3C, the lock lever cam state switch cam 8 is in the unlocking range so as to indicate to the ECU 20 to consider the outside door handle 901 as unlocked. As a result, if the outside door handle 901 were pulled by a person outside the vehicle even if the person does not possess the electronic key fob or a key, the power release actuator 18 actuates the pawl release lever 17 so as to open the rear vehicle door 900.

The power lock mechanism 27 shown in FIGS. 3A-3D includes a double pull override feature that permits the inside release lever 1 to open the vehicle door 900 even if the power lock mechanism 27 is in the locked state. Referring to FIG. 3A, when the power lock mechanism 27 in the locked state, the lock lever cam 6 is in the locking range and thus holds the lock lever 3 in the locked position against the urging of the lock lever biasing member 9. Furthermore, the lock lever cam state switch cam 8 is in the locking range and as a result, the lock lever cam state switch 7 indicates to the ECU 20 that the power lock mechanism 27 is locked so that the ECU 20 operatively disconnects the outside door handle 901 from the pawl release lever 17. Furthermore, the override member 10 is in the actuatable range.

When the inside release lever 1 is actuated (i.e. moved to the actuated position) while the power lock mechanism 27 is in the locked state (see FIG. 3B), the inside release lever 1 does not move the auxiliary release lever 4 to the actuated position. The movement of the inside release lever 1 does, however, drive the override member 10 to move from a first position which is an actuatable position, to a second position which is in the non-actuatable range. Because the lock lever cam 6, the lock lever cam state switch cam 8, and the override member 10 are all connected together, such movement of the override member 10 to the second position (FIG. 3B) results in corresponding movement of the lock lever cam 6 to a position within the unlocking range and results in movement of the lock lever cam state switch cam 8 to a position within the unlocking range. The movement of the lock lever cam state switch cam 8 to within the unlocking range closes the lock lever cam state switch 7 so as to signal to the ECU 20 to permit operative control between the outside door handle 901 and the pawl release lever 17.

While the inside release lever 1 is still actuated, a lock link keeper surface 58 provided thereon holds the lock link 2 in the lock position. As a result, the lock lever 3 remains in the locked position even though the lock lever cam 6 no longer obstructs the movement of the lock lever 3 to the unlocked position. The respective states of the lock lever cam state switch 7 and the lock lever state switch 50 can be used to indicate to the ECU 20 that the power lock mechanism 27 is in an 'override' state.

When the inside release lever 1 is released from the actuated position and moves back to the home position (see FIG. 3C), the keeper surface 58 moves out of the way of the lock link 2, and so the lock link 2 and the lock lever 3 move to their unlocked positions under the urging of the lock lever biasing member 9 (FIG. 3C). As a result, the power lock mechanism 27 is shifted into the unlocked state. Thus, when the power lock mechanism 27 was in the locked state, actuation and return to the home position of the inside release lever 1 has moved the power lock mechanism 27 to the unlocked state shown in FIG. 3C, whereat the inside release lever 1 is operatively connected to the pawl release lever 17 through the lock link 2 and the auxiliary release lever 4. As a result, a second actuation of the inside release lever 1 from its home position to its actuated position functions to move the pawl release lever 17 to its pawl release position so as to move the pawl 15 to its ratchet releasing position so as to release the latch mechanism and open the vehicle door.

When the power lock mechanism 27 is in the child-locked state, shown in FIG. 3D, the lock lever cam 6 is in the locking range and, as a result, the lock link 2 and lock lever 3 are in their locked positions. Furthermore, the override member 10 is in a third position, which is in the non-actuatable range. As a result, the inside release lever 1 is prevented from overriding the power lock mechanism 27 and opening the vehicle door regardless of how many times the release lever 1 is actuated. Furthermore, the lock lever cam state switch cam 8 may be in the locking range, thereby resulting in the operative disconnection between the outside door handle 22 and the pawl release lever 17.

The power lock mechanism 27 may be shifted between its unlocked, locked and child-locked states by the lock actuator 19 rotating the PL gear 56. More specifically, to shift the power lock mechanism 27 from the locked state (FIG. 3A) to the unlocked state (FIG. 3C), the lock motor 11 is actuated to rotate the PL gear 56 in a first direction (clockwise in the view shown in FIG. 3A) until the ECU 20 senses that the lock lever cam state switch cam 8 has moved to the unlocking range based on the state of the switch 7 and that the lock lever cam 6 has moved to the unlocking range based on the state of the switch 50. To shift the power lock mechanism 27 from the unlocked state (FIG. 3C) into the child-locked state (FIG. 3D), the lock motor 11 is actuated to rotate the PL gear 56 in the first direction (clockwise in the view shown in FIG. 3C) until the lock motor 11 stalls as a result of engagement with a component connected to the PL gear 56 with a corresponding stationary limit surface. To move the power lock mechanism 27 from the locked state (FIG. 3A) to the child-locked state (FIG. 3D), the lock motor 11 may be actuated to rotate the PL gear 56 in the first direction (clockwise in the view shown in FIG. 3A) until the lock motor 11 stalls as a result of engagement with a component connected to the PL gear 56 with a corresponding stationary limit surface.

To shift the power lock mechanism 27 from the child-locked state (FIG. 3D) to the unlocked state (FIG. 3C), the lock motor 11 is actuated to rotate the PL gear 56 in a second direction (counter-clockwise in the view shown in FIG. 3D) until the ECU 20 senses that the lock lever cam state switch cam 8 has moved to the unlocking range based on the state of the switch 7, and that the lock lever cam 6 has moved to the unlocking range based on the state of the switch 50. To shift the power lock mechanism 27 from the unlocked state (FIG. 3C) to the locked state (FIG. 3A), the lock motor 11 is actuated to rotate the PL gear 56 in the second direction (counter-clockwise in the view shown in FIG. 3C) until the lock motor 11 stalls as a result of engagement with a component connected to the PL gear 56 with a corresponding limit surface. To shift the power lock mechanism 27 from the child-locked state (FIG. 3D) to the locked state (FIG. 3A), the lock motor 11 may be actuated to rotate the PL gear 56 in the second direction (counter-clockwise in the view shown in FIG. 3D) until the lock motor 11 stalls as a result of engagement with a component connected to the PL gear 56 with a corresponding limit surface.

During the aforementioned movements of the lock components, the lock state can be indicated to the ECU 20 by the state of the lock lever cam state switch 7 and additionally in some cases by the most recent command issued by the ECU 20 to the lock motor 11. More specifically, if the switch 7 indicates a locked state, and the most recent command by the ECU 20 was to rotate the lock motor 11 in the first direction, then the power lock mechanism 27 is in the child-locked state. If the switch 7 indicates a locked state and the most recent command by the ECU 20 was to rotate the lock motor 11 in the second direction, then the power lock mechanism 27 is in the locked state. If the switch 7 is indicates an unlocked state, then the power lock mechanism 27 is in the unlocked state regardless of the most recent command issued by the ECU 20 to the lock motor 11. It will be noted that the lock state of the power lock mechanism 27 could alternatively be determined by the state of the lock lever state switch 50 instead of the state of the switch 7.

Figure 3B:
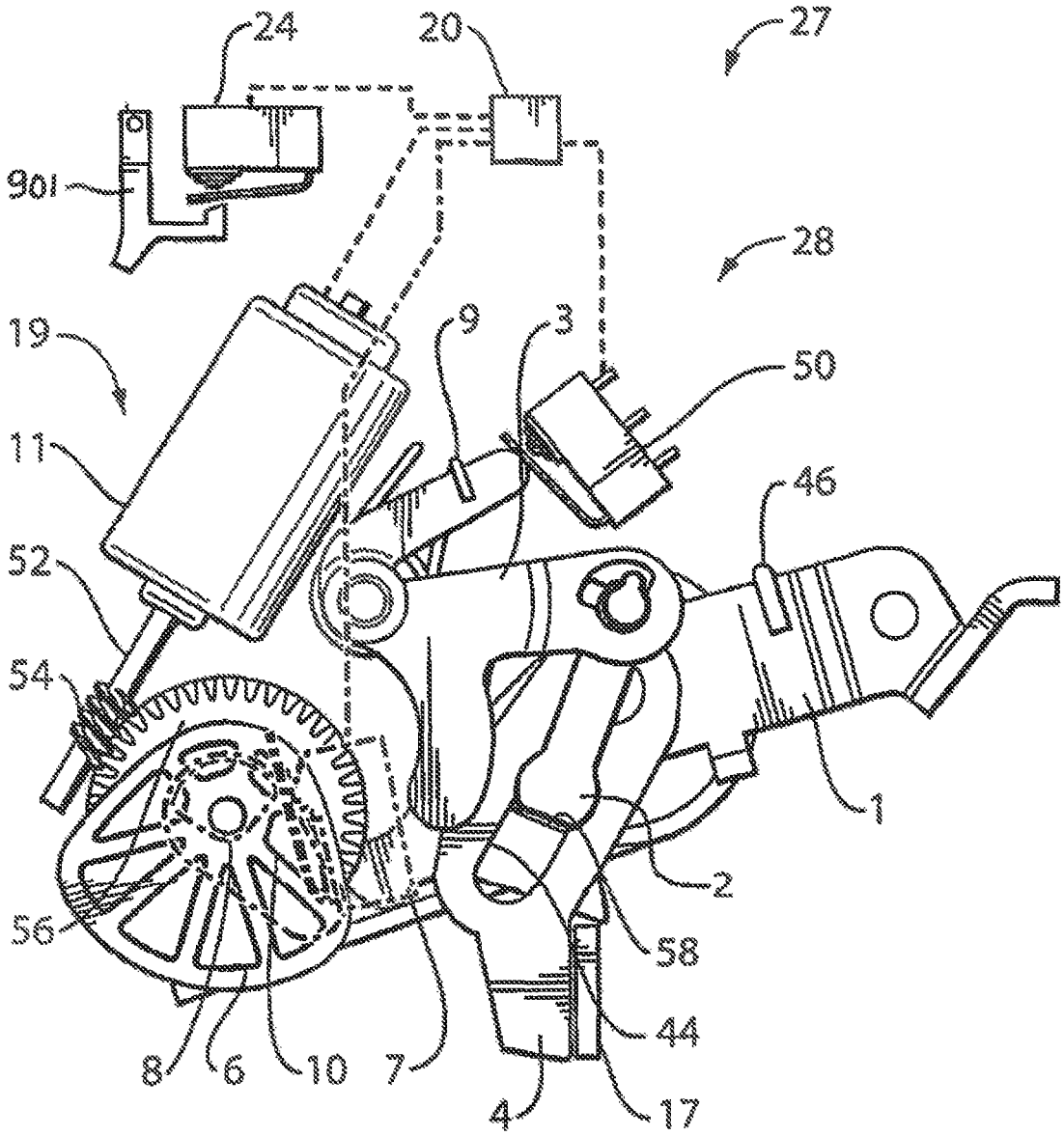
FIG. 3B is a plan view of the lock mechanism in an override state.
Figure 3C:
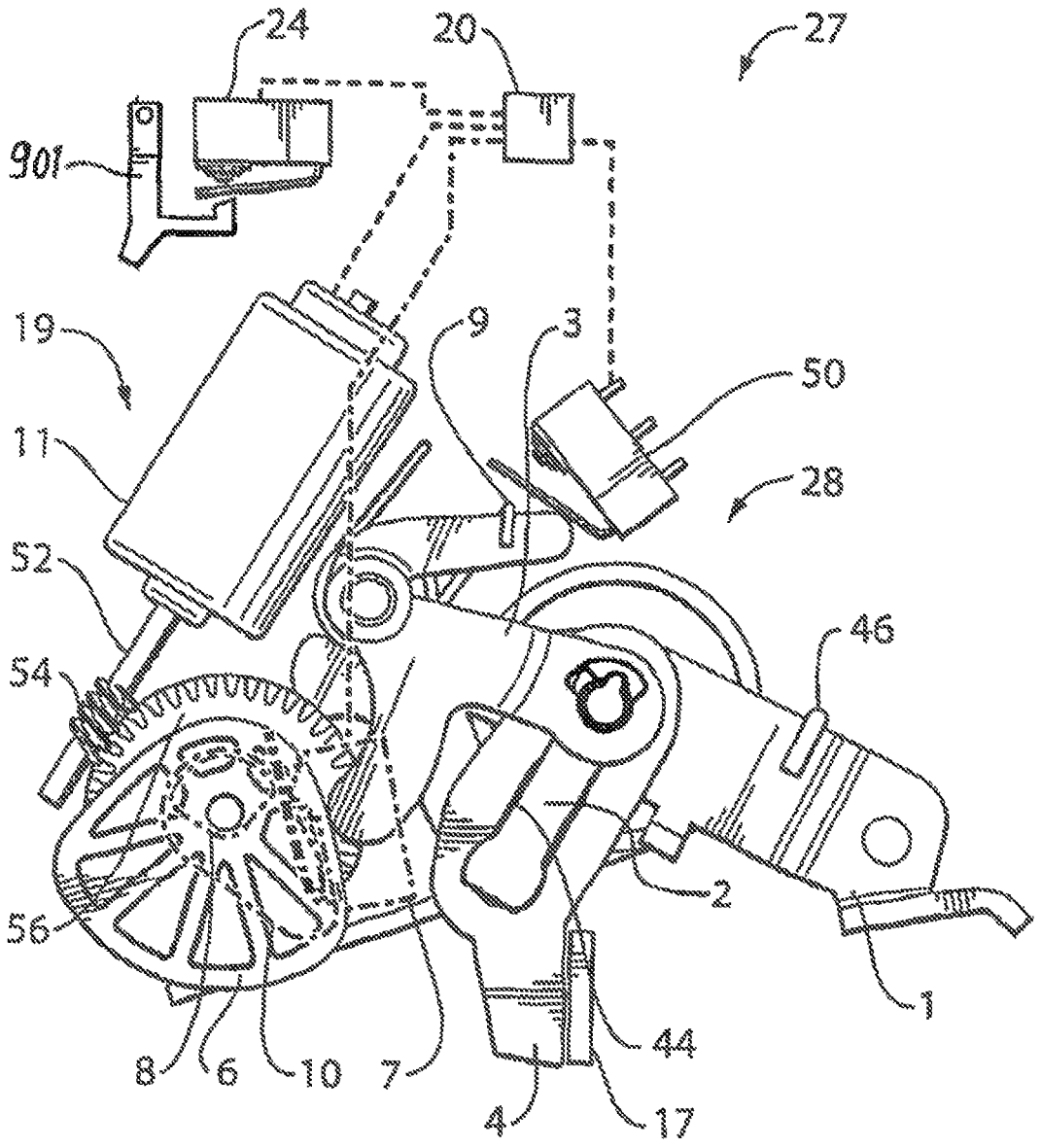
FIG. 3C is a plan view of the lock mechanism in an unlocked state.
Figure 3D:
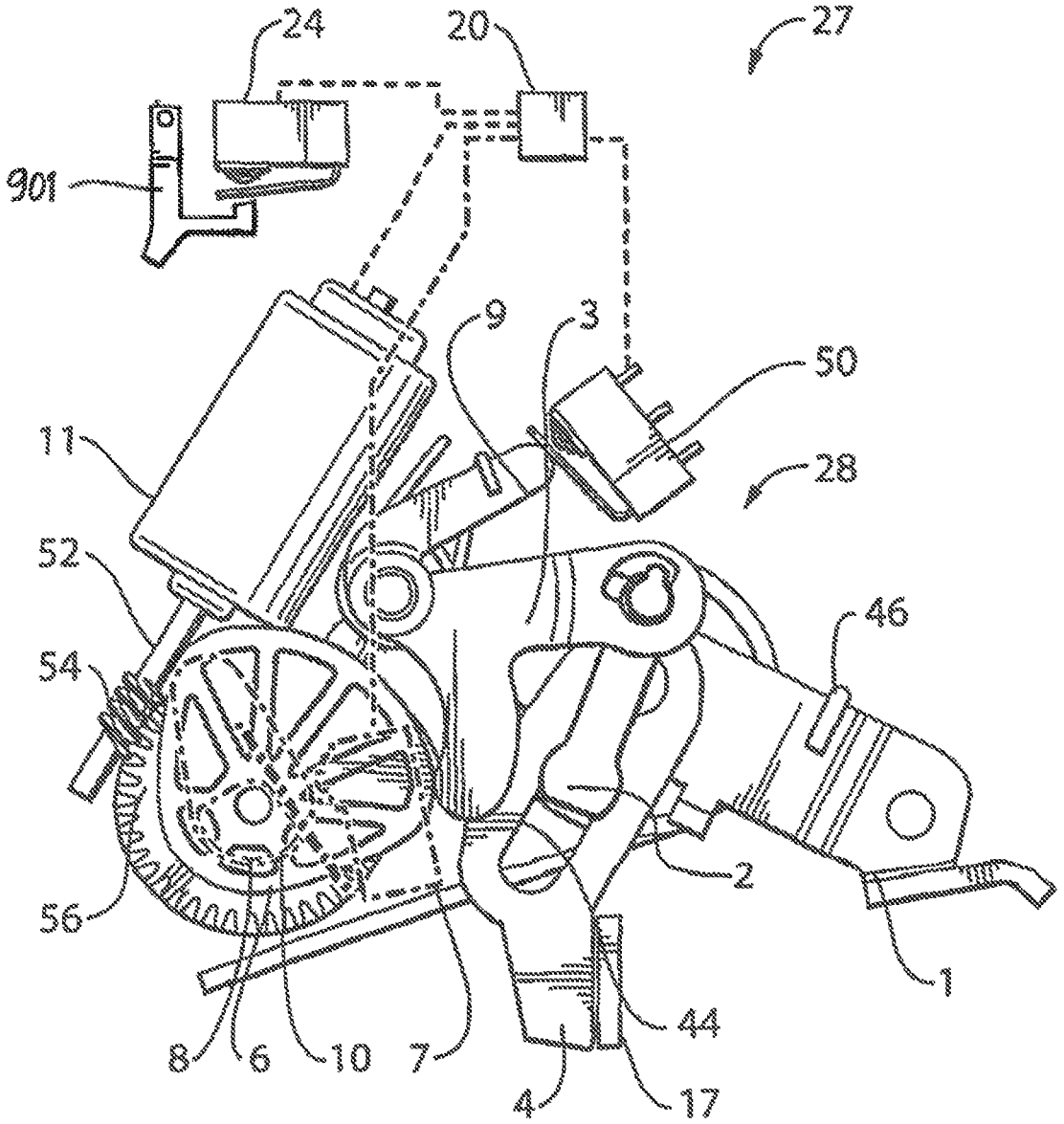
FIG. 3D is a plan view of the lock mechanism in a child-locked state.

The power lock mechanism 27 shown in FIGS. 3A-3D may include a 'panic' feature, which permits the state to be changed from the child-locked state (FIG. 3D) to the unlocked state (FIG. 3C), while the inside release lever 1 is in the actuated position (FIG. 3B). Because the keeper surface 58 on the inside release lever 1 keeps the lock lever 3 in the locked position, the lock lever 3 does not obstruct the movement of the lock lever cam 6 counter-clockwise to the unlocking range. As a result, when the inside release lever 1 is released and moves back to the home position, the lock lever 3 can move to the unlocked position, and the power lock mechanism 27 at that point will be in the unlocked state. Thus, the power lock mechanism 27 permits the closure latch assembly 13 to receive and act upon an instruction to unlock, even when a vehicle occupant has actuated the inside release lever 1 and holds the release lever 1 in the actuated position.

In the child-locked state, the power lock mechanism 27 does not permit the inside release lever 1 to unlatch the closure latch assembly 13, but the power lock mechanism 27 may permit the inside release lever 1 to unlock the outside door handle 901 so that the outside door handle 901 can subsequently be used to unlatch the closure latch assembly 13. To achieve this, an inside release lever state switch shown at 70 may be provided for indicating to the ECU 20 the state of the inside release lever (i.e. for indicating to the ECU 20 whether the inside release lever 1 is in the home position or the actuated position). When the inside release lever 1 is actuated, the ECU 20 can sense the actuation and if the power lock mechanism 27 is in the child-locked state, the ECU 20 can unlock the outside door handle 901. When the inside release lever 1 is actuated while the power lock mechanism 27 is in the second locked state, the ECU 20 would not unlock the lock link 2 or the outside door handle 901.

Instead of the lock motor 11 being capable of rotating the PL gear 56 to a selected position associated with the child-locked state of the power lock mechanism 27, it is alternatively possible for movement of the power lock mechanism 27 into and out of the child-locked state to be manually controlled, (e.g. via child lock mechanism 910 having a manually-operated lever that protrudes from edge face 903 of the rear vehicle door 900. In such an embodiment, the child lock mechanism 910 may include a separate child lock cam that engages a suitable part of the lock lever 3 to control whether the lock lever 3 is movable from the locked position to the unlocked position. The child lock cam may be rotatable between a locking range of positions and a non-locking range of positions. Because the child locking capability is provided by the manually controlled child lock mechanism 910, the ECU 20 can operate the motor 11 to rotate the PL gear 56 between two positions instead of three positions. The two positions would correspond to an unlocked state of the outside door handle 22 and, for example, a locked state.

Figure 4:
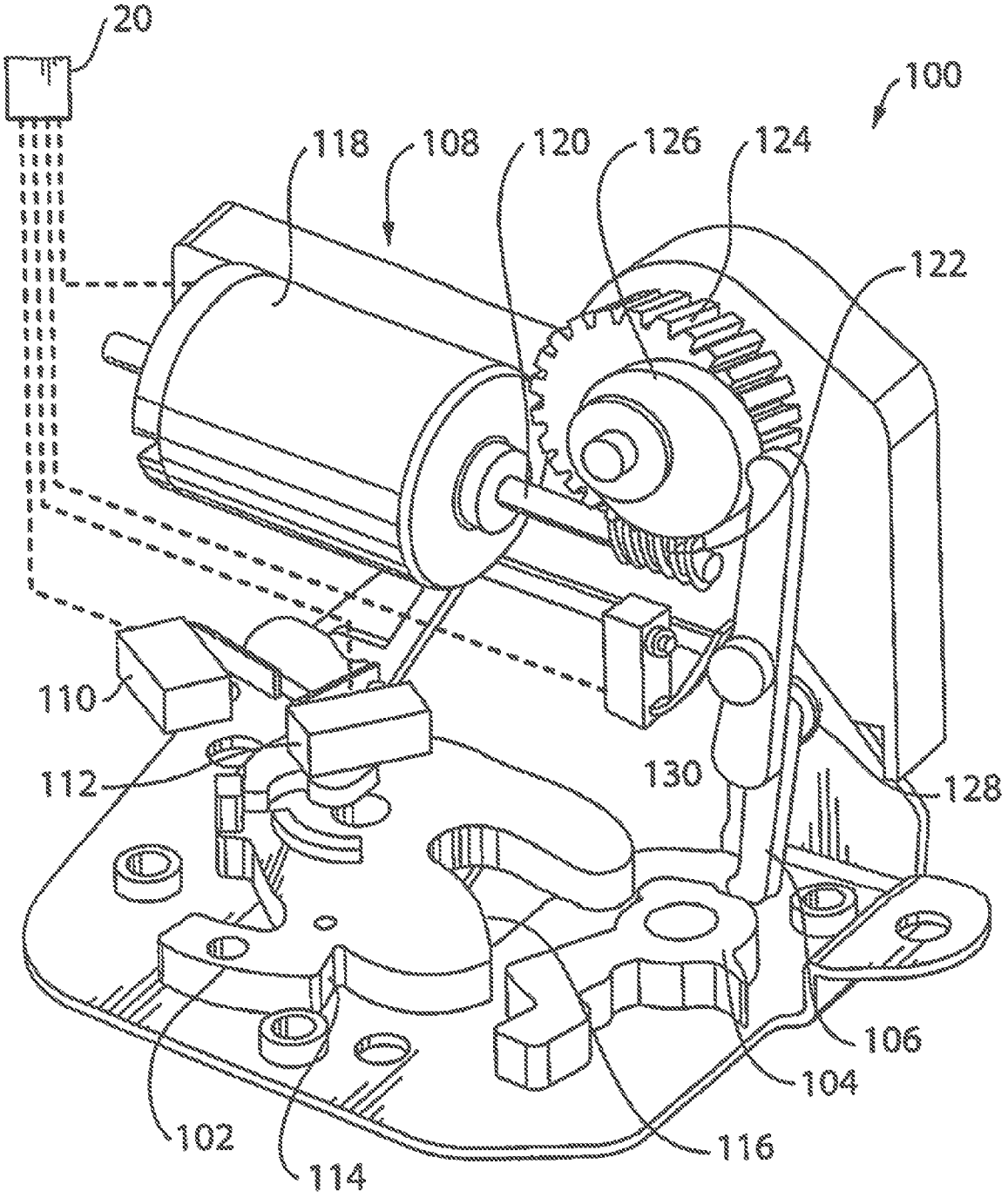
FIG. 4 is a perspective view of various components associated with another version of the closure latch assembly.
Figure 5:
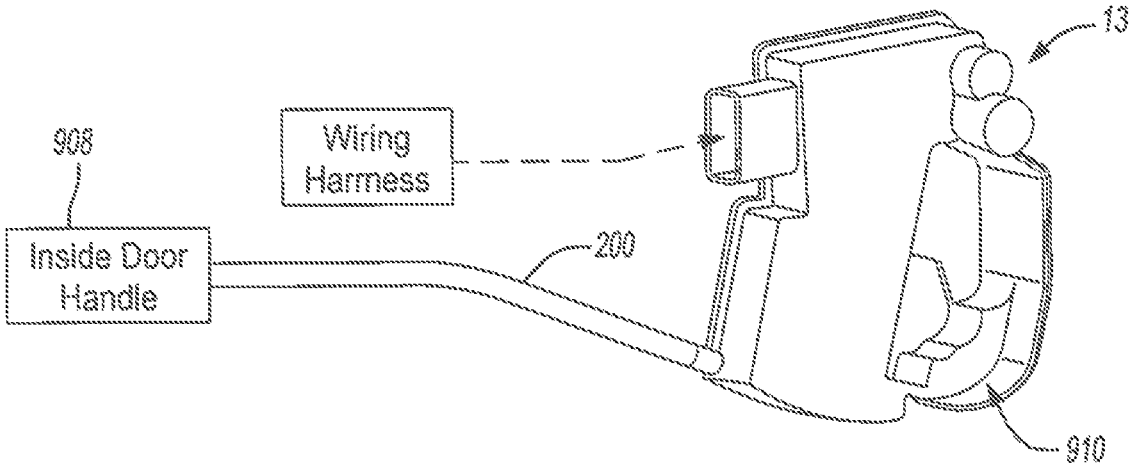
FIG. 5 PRIOR ART
FIG. 5 illustrates a conventional mechanical connection between an inside door handle on the rear door and an inside latch release mechanism associated with the closure latch assembly equipped with the child lock mechanism.

Reference is now made to FIG. 4, which shows another embodiment of a closure latch assembly 100. The closure latch assembly 100 includes a latch mechanism having a ratchet 102 and a pawl 104 (which may be similar to the ratchet 14 and pawl 15 in FIG. 2) and which may be biased to the open position for the ratchet and to the ratchet holding position for the pawl by suitable biasing members, a latch release mechanism having a pawl release lever 106, and a power release mechanism 108. The ratchet 102 may have structure thereon for tripping two switches, shown at 110 and 112. The first switch 110 may be a door-ajar indicator switch, which is positioned to indicate a condition where the ratchet 102 is in the secondary position (i.e. where the pawl 104 holds the secondary locking surface, shown at 114 of the ratchet 102 instead of holding the primary locking surface 116). The second switch 112 may be used to indicate that the ratchet 102 is open (thereby indicating that the vehicle door 900 is open).

The power release mechanism 108 includes a power release motor 118 with an output shaft 120 having a worm gear 122 which drives a power release (PR) gear 124. The PR gear 124 has a release lever actuation cam 126 connected thereto which pivots the pawl release lever 106 from a home position to a pawl release position. A release lever biasing member 128 may be provided to bias the pawl release lever 106 towards its home position.

When the power release mechanism 108 is used to release the pawl 104 to open the vehicle door 900, the ECU 20 may run the power release motor 118 until the ECU 20 receives a signal that the vehicle door 900 is open (from switch 112), or until a selected time period has elapsed, indicating that the vehicle door 900 is stuck (e.g. from snow or ice buildup on the vehicle). Upon receiving a signal from the door state switch that the vehicle door 900 is open, the ECU 20 can send a signal to the motor 118 to reset the ratchet 102 and pawl 104 so that the pawl 104 is ready to lock the ratchet 102 when the vehicle door 900 is closed.

The ECU 20 may receive signals from an inside door handle state switch (not shown in FIG. 4) and from the outside door handle state switch 24 which indicate to the ECU 20 whether either of the inside door handle 908 and the outside door handle 901 is in the home position or in the actuated position. The ECU 20 can provide any of several lock states including child-locked, unlocked, double-locked and locked, by selectively acting upon or ignoring actuation signals from the inside door handle 908 and/or the outside door handle 901. These lock states may be logical states of the ECU 20. Functions such as double-pull override can be provided, whereby the ECU 20 unlocks the inside door handle upon a first actuation of the inside door handle (while the latch is locked). A pawl release lever state switch 130 may be provided that senses the position of the pawl release lever 106. The state switch 130 can be used to indicate to the ECU 20 when the pawl release lever 106 has reached the actuated position.

Closure latch assemblies 13, 100 provide a power child lock function. However, it is also known that such closure latch assemblies can also be equipped with a manually-controlled child lock mechanism 910 (FIG. 1) configured, for example, to include a child lock cam operable in a locking position to hold lock lever 3 in its locked position and in an unlocking position to hold lock lever 3 in its locked position. Thus, manually-controlled child lock mechanism 910 can be mechanically shifted between the child-locked state and the unlocked state. Unfortunately, if electrical power is lost or unavailable, power lock mechanism 27 is unable to be shifted from its child-locked state into its locked state or its unlocked state for allowing subsequent manual opening of rear door 900 via the double pull release (locked state) or single pull release (unlocked state). Moreover, manually-controlled manual child lock mechanism 910 is traditionally located along rear door edge 903 of rear door 900, no access is provided to permit manual shifting out of the child-locked state until rear door 900 is subsequently opened. Such a conventional arrangement is shown in FIGS.

1 and 5 with inside handle 908 shown mechanically connected to the inside release lever 1 via a suitable connector 200 (i.e. cable, linkage, etc). Thus, in the event of a power failure, power lock mechanism 27 cannot be shifted from the child-locked state into the locked state or the unlock state and any attempt to open rear door 900 via actuation of inside door handle 908 is useless.

Figure 6:
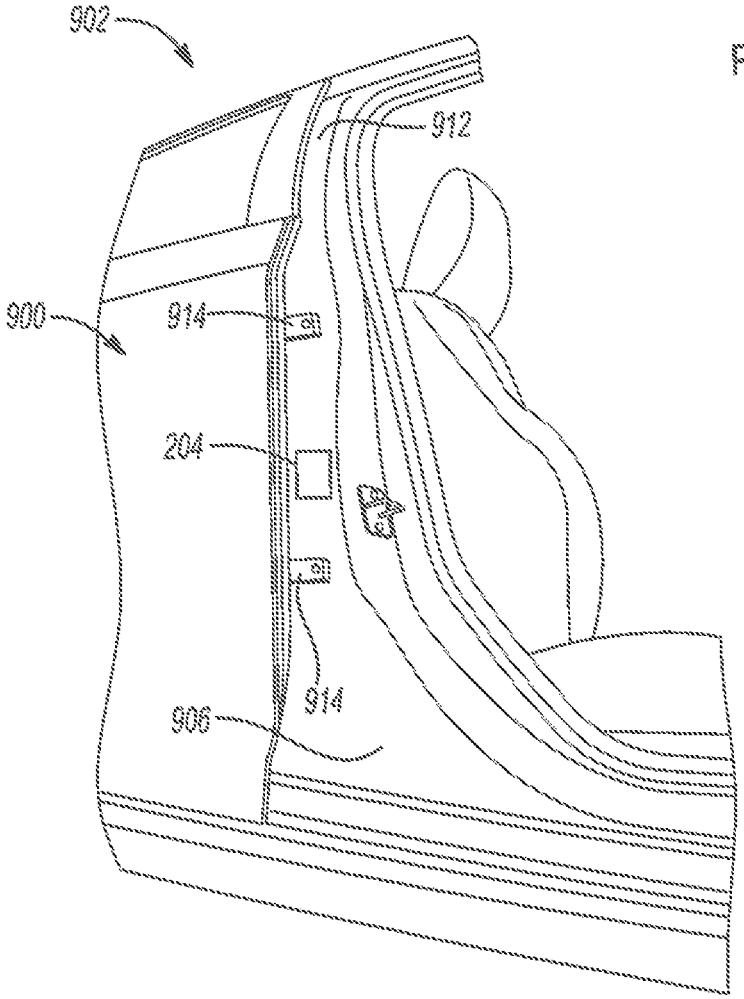
FIG. 6 is a pictorial view illustrating an emergency child lock release mechanism mounted at the B-pillar of the motor vehicle to provide access when the front door is open.

To address this concern, the present disclosure is directed to providing a vehicular closure system having an emergency child lock release mechanism operatively associated with closure latch assembly 13 and which is located to allow actuation when the front door 907 is opened. To this end, FIG. 6 illustrates an emergency child lock release actuator 204 mounted to a B-pillar 912 of vehicle body 906 between a pair of door hinges 914 which support rear door 900 for swinging movement relative to vehicle body 906. As such, access is provided to manually control actuation of child lock release actuator 204 when front door 907 is opened.

Figure 7:
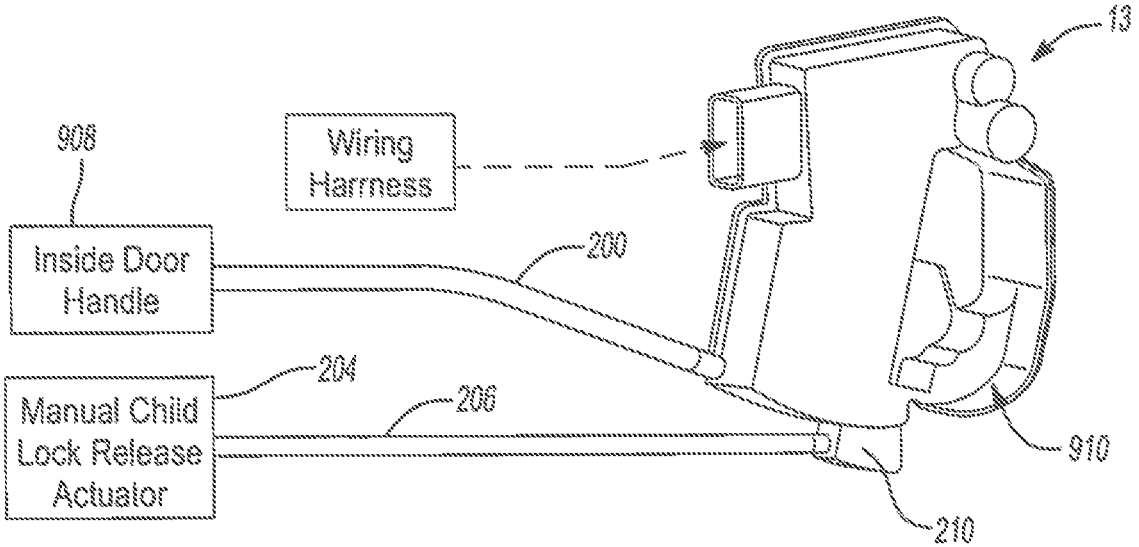
FIG. 7 illustrates a first arrangement according to the present disclosure which locates the emergency child lock release mechanism along the B-pillar shown in FIG. 6 and which is mechanically connected to the child lock mechanism of the closure latch assembly.

FIG. 7 illustrates a first arrangement wherein manually-operable child lock release actuator 204 is mechanically and/or operatively connected via a suitable connection device 206 (i.e. cable, linkage, etc) to a child lock override linkage 210 coupled to power-operated lock mechanism 27 and/or to manual child lock mechanism 910 of closure latch assembly 13. Preferably, child lock release actuator 204 is a moveable actuator element (i.e. toggle, pull handle, lever, etc) that is moveable from a first or non-actuated position into a second or actuated position to cause the child lock mechanism associated with closure latch assembly 13 to be mechanically shifted from its child-locked state into its child-unlocked state. Thereafter, the double pull release function associated with inside handle 908 and the inside release mechanism can be used to shift into the unlocked state and subsequently actuate the latch release mechanism for opening rear vehicle door 900. In accordance with an embodiment, the closure latch assembly 13 includes a double pull inside release function such that when the child lock mechanism 910 is in its child-unlocked state after actuation of the release actuator 204, a first pull of the inside door handle 908 shifts a lock mechanism associated with the closure latch assembly 13 from a locked state to an unlocked state (for example via the ECU 20 issuing a command to the lock motor 11 of the power lock mechanism 27 to shift from the locked state to the unlocked state), and wherein a second pull of the inside door handle 908 causes release of the latch mechanism associated with the closure latch assembly 13 (for example via the ECU 20 actuating the power release mechanism 18 to release the latch mechanism and unlatch the closure latch assembly 13 for opening the rear door 900, as previously illustratively described hereinabove).

Figure 8:
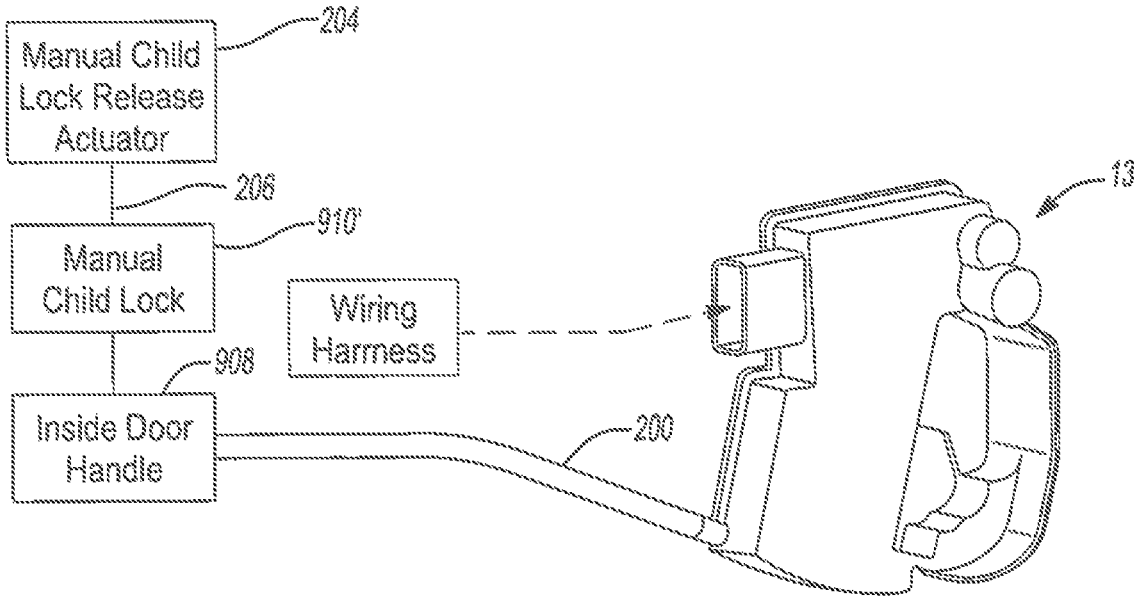
FIG. 8 illustrates a second arrangement according to the present disclosure which connects the emergency child lock release mechanism to a child lock mechanism associated with the inside door handle.

Referring now to FIG. 8, an alternative arrangement is shown in the situation where a child lock mechanism 910' is operable in association with inside door handle 908 instead of with closure latch assembly 13. As seen, manual child lock release actuator 204 is mechanically and/or operatively connected via a suitable connection device 206 to child lock mechanism 910'. As before, child lock release actuator 204 is located along B-pillar 912 between door hinges 914 to provide access thereto when front door 907 is opened. Upon actuation, child lock mechanism 910' is shifted into its unlocked state so as to permit inside handle 908 to be used to release the latch mechanism and open rear vehicle door 900.

Figure 9:
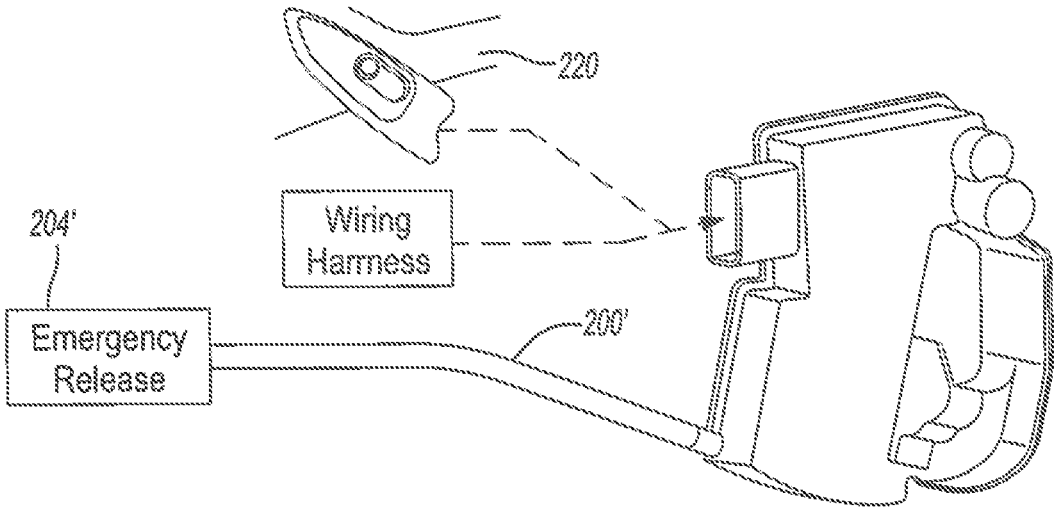
FIG. 9 illustrates a third arrangement according to the present disclosure providing an emergency release mechanism in association with an electronic inside door handle.

Referring now to FIG. 9, a slightly revised arrangement is shown for use when no inside release handle 908 is provided in association with rear door 900. An electronic inside release device 220 (i.e. switch, release button, toggle, etc) is shown such that no mechanical inside release connection is provided between rear door 900 and closure latch assembly 13 to facilitate a mechanical double pull inside release operation in the event that power is lost. In this case, a manually-operable emergency latch release actuator 204' is mechanically connected via a suitable connector device 200' to the latch release mechanism of closure latch assembly 13. Emergency latch release actuator 204' is again located along B-pillar 912 between hinges 914 to be accessible for manual actuation when front door 907 is opened. In this arrangement, actuator 204 is not configured to interact with a child lock mechanism, but rather with the latch release mechanism.

While emergency release actuator devices 204, 204' are disclosed as located between hinges 914, those skilled in the art will recognize that any suitable location along the B-pillar that is accessible when front door 907 is open is contemplated as being within the scope of this disclosure. Moreover, such an emergency release actuation arrangement can be used to provide other manually-controlled release and/or state shifting functions including backup release and backup double lock release.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. In a motor vehicle having a front door mounted to an A-pillar and a rear door mounted to a B-pillar, a closure system comprising:

a closure latch assembly mounted to the rear door; and an emergency release mechanism mounted to the B-pillar and accessible when the front door is open, the emergency release mechanism being operatively coupled to the closure latch assembly so as to permit manual release of the closure latch assembly via actuation of the emergency release mechanism.

2. The closure system of claim 1 wherein the closure latch assembly includes a child lock mechanism operable in a child-locked state and a child-unlocked state, and wherein the emergency release mechanism is operable for shifting the child lock mechanism from its child-locked state into its child-unlocked state to permit subsequent release of a latch mechanism associated with the closure latch assembly in response to actuation of an inside door handle associated with the rear door.

3. The closure system of claim 2 wherein the child lock mechanism is a power-operated child lock mechanism.

4. The closure system of claim 2 wherein the child lock mechanism is a manually-controlled child lock mechanism.

5. The closure system of claim 2 wherein the emergency release mechanism includes a manually-operable release actuator and a coupling device operatively connecting the release actuator to the child lock mechanism.

6. The closure system of claim 5 wherein the release actuator is located along the B-pillar between a pair of hinges supporting the rear door and which is accessible when the front door is open.

7. The closure system of claim 5 wherein the release actuator is connected to the child lock mechanism via the coupling device, and wherein the child lock mechanism is associated with the inside door handle.

8. The closure system of claim 5 wherein the closure latch assembly includes a double pull inside release function such that when the child lock mechanism is in its child-unlocked state after actuation of the release actuator, a first pull of the inside door handle shifts a lock mechanism associated with the closure latch assembly from a locked state to an unlocked state, and wherein a second pull of the inside door handle causes release of the latch mechanism associated with the closure latch assembly.

9. The closure system of claim 5 wherein the release actuator is moveable from a non-actuated position to an actuated position for causing the coupling device to shift the child lock mechanism from the child-locked state into the child-unlocked state.

10. The closure system of claim 1 wherein the emergency release mechanism is operable for shifting a lock mechanism associated with the closure latch assembly from a locked state to an unlocked state to permit subsequent release of a latch mechanism associated with the closure latch assembly in response to actuation of an inside door handle associated with the rear door.

11. The closure system of claim 1 wherein the emergency release mechanism is operable for shifting a latch mechanism associated with the closure latch assembly from a latched state into an unlatched state for releasing the rear door for movement to the open position.

12. The closure system of claim 1 wherein the emergency release mechanism is accessible when the rear door is closed.

13. The closure system of claim 1 wherein the emergency release mechanism is external from the closure latch assembly.

14. The closure system of claim 5 wherein the coupling device is external from the closure latch assembly.

15. In a motor vehicle having a front door mounted to an A-pillar and a rear door mounted to a B-pillar, a closure system comprising:

a closure latch assembly mounted to the rear door; and an emergency release mechanism located along the B-pillar and accessible when the front door is open and when the rear door is closed, the emergency release mechanism being operatively coupled to the closure latch assembly so as to permit manual release of the closure latch assembly via actuation of the emergency release mechanism.

16. The closure system of claim 15 wherein the emergency release mechanism is external from the closure latch assembly.

17. The closure system of claim 16 wherein the emergency release mechanism includes a release actuator and a coupling device operatively connecting the release actuator to the closure latch assembly.

* * * * *